US007156055B1

(12) United States Patent
Craig

(10) Patent No.: US 7,156,055 B1
(45) Date of Patent: Jan. 2, 2007

(54) COOLANT REGULATING SYSTEM FOR TRACTOR TRAILERS

(76) Inventor: Stephen H. Craig, 2045 Whitney Ave., North Haven, CT (US) 06473

( * ) Notice: Subject to any disclaimer, the term of this patent is extended or adjusted under 35 U.S.C. 154(b) by 0 days.

(21) Appl. No.: 11/245,983

(22) Filed: Oct. 11, 2005

(51) Int. Cl.
*F01P 9/00* (2006.01)

(52) U.S. Cl. ..... 123/41.01; 165/41; 237/12.3 B

(58) Field of Classification Search ..... 123/41.01; 165/41; 237/12.3 B
See application file for complete search history.

(56) References Cited

U.S. PATENT DOCUMENTS 3,304,004 A 2/1967 Hraboweckyj
4,756,359 A 7/1988 Greer
4,865,005 A 9/1989 Griffith
RE33,687 E 9/1991 Greer
5,908,069 A 6/1999 Baldwin et al.
6,415,625 B1 7/2002 Rockenfeller et al.

*Primary Examiner*—Noah P. Kamen

(57) ABSTRACT

A system includes a control switch mounted in a tractor cabin and is electrically mated to a power source of the tractor. A first coolant is housed within the tractor's engine and a second coolant is housed within a trailer's heating system. The first and second coolants have unique boiling and freezing temperatures respectively. A mechanism is included for simultaneously transferring heat from the first coolant to the second coolant while maintaining the coolants isolated. The first and second coolants have first temperatures entering and second temperatures exiting the heat transferring mechanism, respectively. The first coolant second temperature is lower than the second coolant second temperature. Mechanism are included for controlling an input flow rate of the second coolant upstream from the heat transfer mechanism and for replenishing the second coolant as heat is transferred between the first and second coolants.

15 Claims, 3 Drawing Sheets

COOLANT REGULATING SYSTEM FOR TRACTOR TRAILERS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to coolant regulating systems and, more particularly, to a coolant regulating system for tractor engines and associated trailer heating systems.

2. Prior Art

Many tractor trailers pull temperature controlled trailer units commonly known as tank trailers which carry temperature sensitive goods. The sensitive tank trailer must continuously be kept at hot operating temperature in order to prevent goods from being damaged. Conventionally, the truck's cooling system and the tank trailer's heating system are integrated to be heated by the same cooling unit with antifreeze.

This practice, however, is not desirable, since cross-contamination occurs between antifreeze entering from the trailer and antifreeze entering from the truck's engine. Such cross-contamination can lead to serious engine troubles that are costly to repair and can leave a truck driver stranded at inopportune times. The integrated cooling system also tends to use antifreeze much more rapidly than in trucks that are only required to cool the engine.

Accordingly, a need remains for a coolant regulating system for tractor trailers in order to overcome the above-noted shortcomings. The present invention satisfies such a need by providing a coolant regulating system that is safe and convenient to use, cost-effective, and provides liquid product temperature protection. Instead of risking contamination of the truck's cooling system from antifreeze, or dirt and debris from the trailer, the system provides effective separation. This enables heat to transfer from the engine antifreeze to the tanker without risking engine damage. The system provides peace of mind to concerned truck drivers and keeps revenue producing commercial trucking equipment operational for longer periods of time.

BRIEF SUMMARY OF THE INVENTION

In view of the foregoing background, it is therefore an object of the present invention to provide a coolant regulating system for tractor trailer tanks. These and other objects, features, and advantages of the invention are provided by a system for separating coolants and reducing the likelihood of coolant contamination between tractor engines and associated trailers.

The system includes a control switch mounted to an internal cabin of the tractor such that a driver can conveniently manually toggle the system between operating and non-operating modes. Such a control switch is electrically mated to an existing power source of the tractor. A first coolant is housed within the tractor's engine and a second coolant is housed within a trailer's heating system. Such first and second coolants have unique boiling and freezing temperatures respectively.

A mechanism is included for simultaneously transferring heat from the first coolant to the second coolant while advantageously and effectively maintaining the first and second coolants isolated during operating conditions. The first coolant has a first temperature entering the heat transferring mechanism and further has a second temperature upon exiting the heat transferring mechanism. The second coolant has a first temperature entering the heat transferring mechanism and further has a second temperature upon exiting the heat transferring mechanism. The second temperature of the first coolant is lower than the second temperature of the second coolant.

The heat transfer mechanism preferably includes a housing seated to an exterior and intermediate of the tractor engine and the trailer heating system respectively. A pair of inlet ports are in direct fluid communication with existing coolant lines associated with the tractor engine and the trailer heating system respectively. A pair of outlet ports are in direct fluid communication with selected ones of the existing coolant lines. A water-to-water heat exchanging device is seated within the housing and is in direct fluid communication with the inlet and outlet ports such that the first and second coolants fluidly pass through the heat exchanging device while thermally transferring energy therein. The first temperature of the first coolant is greater than the second temperature thereof. The first temperature of the second coolant is less than the second temperature thereof.

A mechanism is included for controlling an input flow rate of the second coolant upstream from the heat transfer mechanism. Such a flow rate controlling mechanism may include a plurality of solenoid valves operably connected to the input and output ports. An electric pump is operably mated to the existing coolant lines. A thermostatic rheostat is directly coupled to the electric pump. Such a thermostatic rheostat regulates a supply of power to the electric pump. The solenoid valves are independently adaptable between open and closed positions for effectively allowing the second coolant to freely flow through the heat exchanging device when the thermostatic rheostat detects that the first temperature of the second coolant has dropped below a predetermined threshold temperature level.

A mechanism is included for conveniently replenishing a selected quantity of the second coolant as heat is transferred between the first and second coolants. The replenishing mechanism preferably includes a reservoir seated within the housing that is fluidly connected directly to the heat exchanging device. A selected volume of the second coolant is housed within the reservoir. A gauge is operably mated to the reservoir for conveniently and effectively displaying a level of the second coolant remaining in the reservoir. Such a reservoir is isolated from one input port and one output port associated with the first coolant such that the first and second coolants advantageously remain isolated during heat transfer procedures. The reservoir may further include a one-way air valve operably conjoined directly thereto for conveniently and effectively reducing an internal air pressure of the reservoir as an internal temperature of the reservoir rises above a predetermined threshold level.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
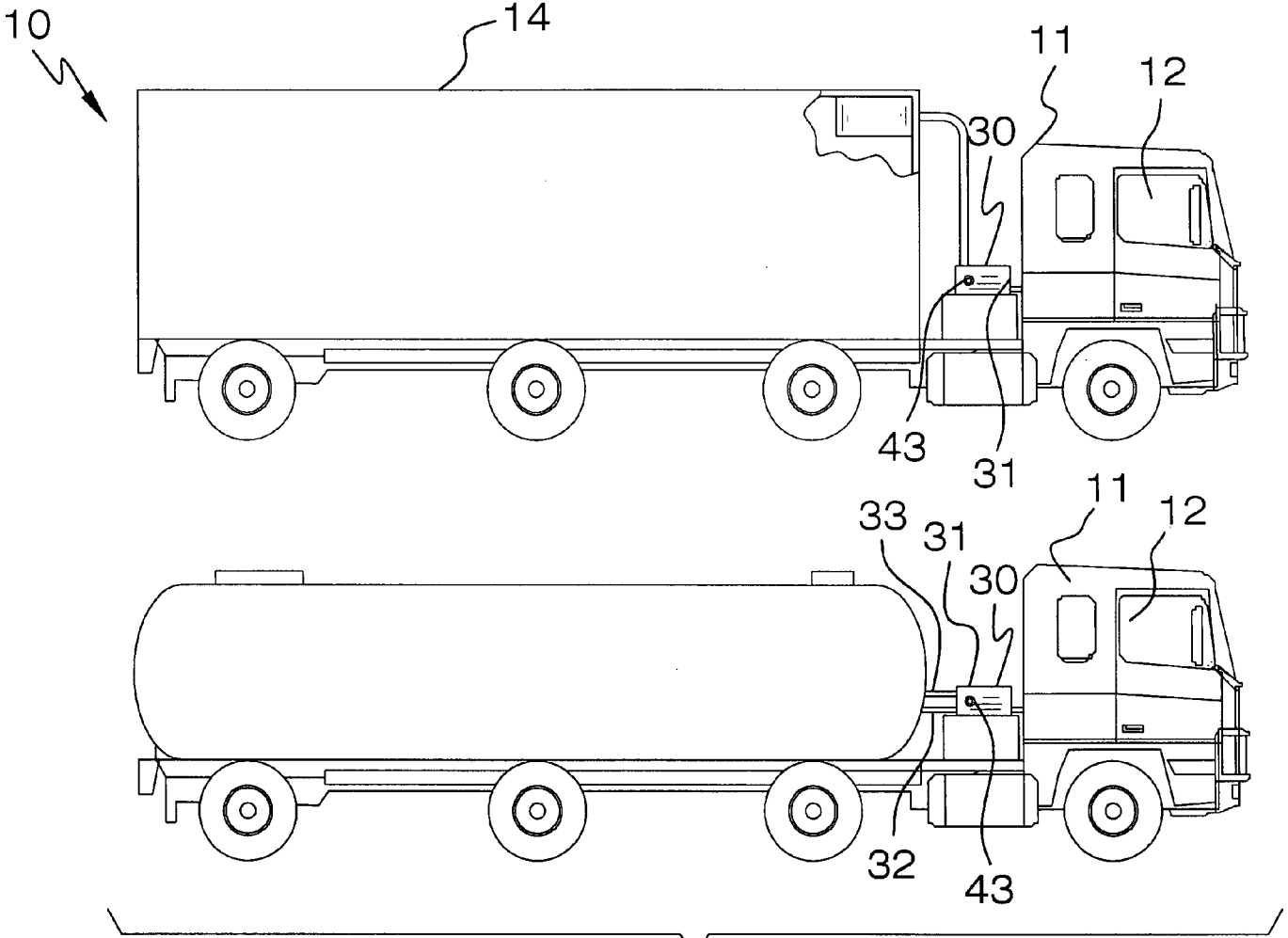
FIG. 1 shows side elevational views of the present invention employed by various tractor trailers.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1–4 by the reference numeral 10 and is intended to provide a coolant regulating system for tractor trailers. It should be understood that the system 10 may be used to regulate temperature in many different types of settings and should not be limited in use to only tractor trailers.

Figure 4:
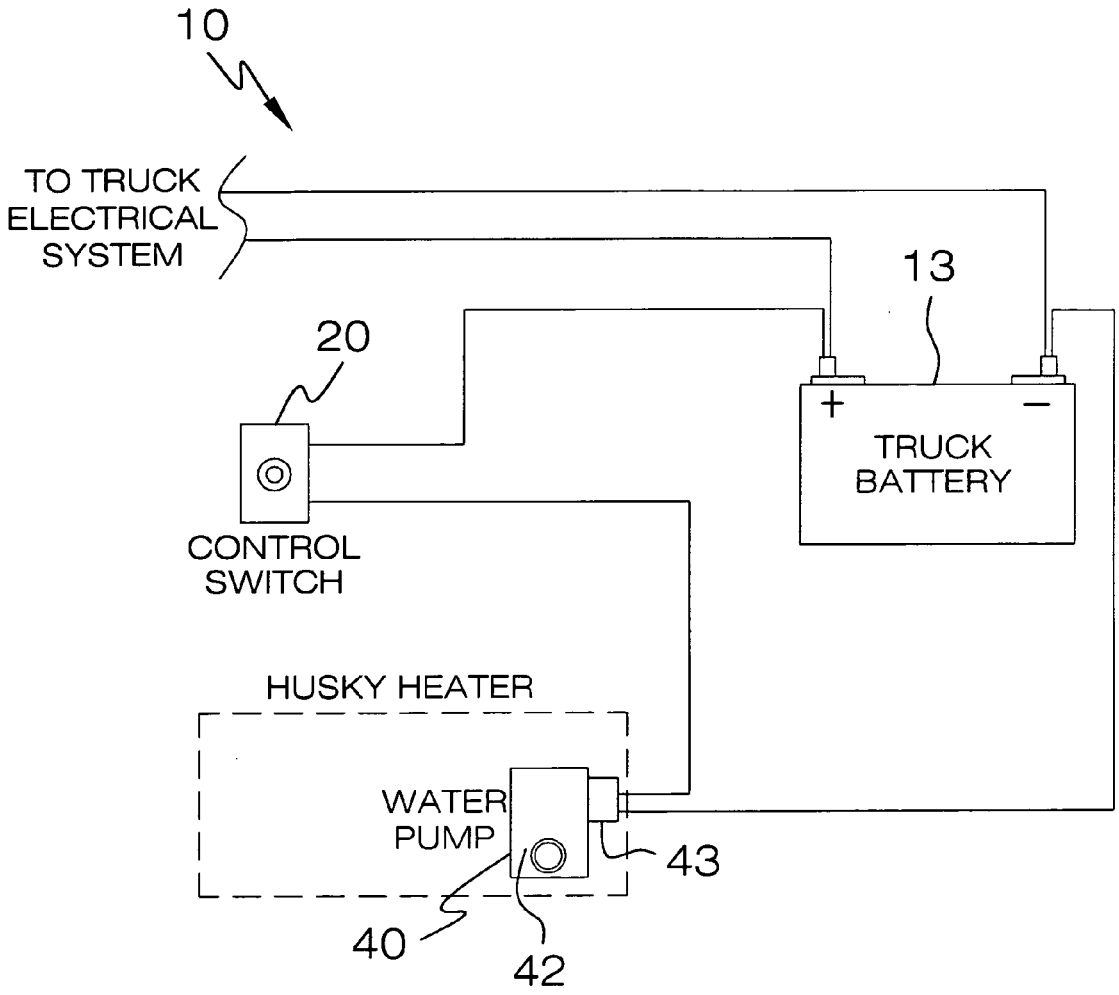
FIG. 4 is a schematic block diagram showing the water pump and control switch operably coupled to the tractor's power supply source.

Referring initially to FIG. 4, the system 10 includes a control switch 20 mounted to an internal cabin 12 of the tractor 11, which is important such that a driver can conveniently manually toggle the system between operating and non-operating modes without having to exit or cease operation of the tractor 11. Such a control switch 20 is electrically mated to an existing power source 13 of the tractor 11. A first coolant 21 is housed within the tractor's engine and a second coolant 22 is housed within a trailer's 14 heating system. Such first 21 and second 22 coolants have unique boiling and freezing temperatures respectively, which is an essential for allowing heat transfer to occur between the first 21 and second 22 coolants.

Figure 2:
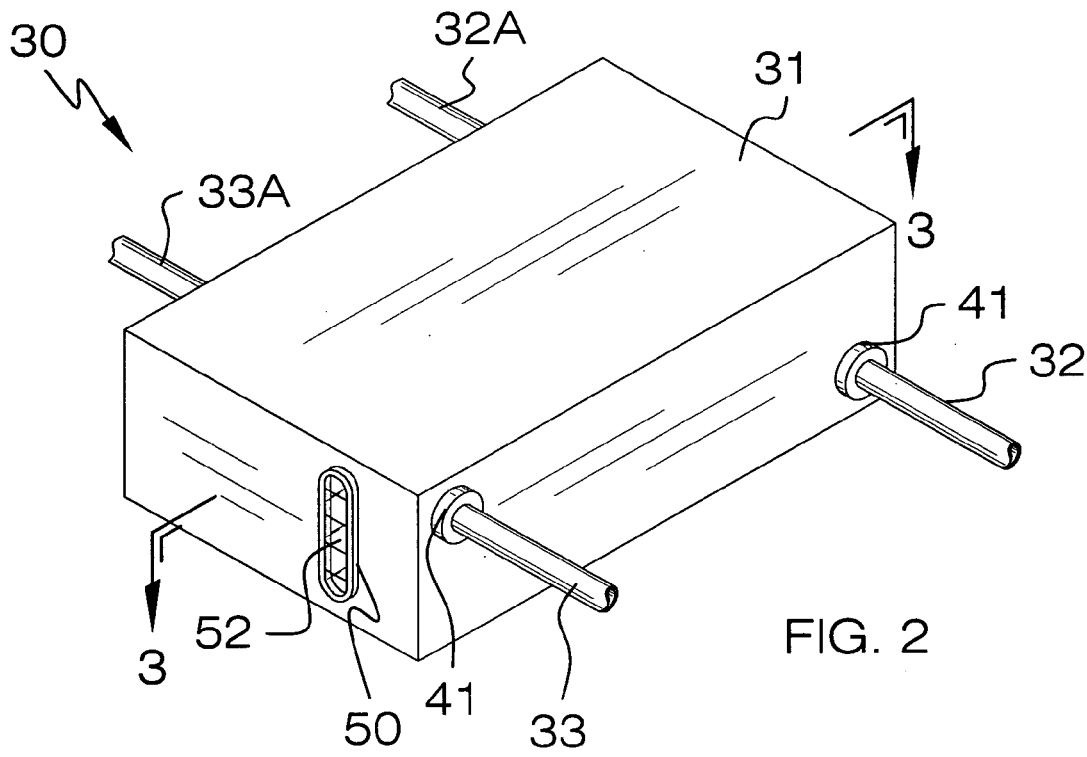
FIG. 2 is a perspective view showing the housing of heat transferring mechanism.
Figure 3:
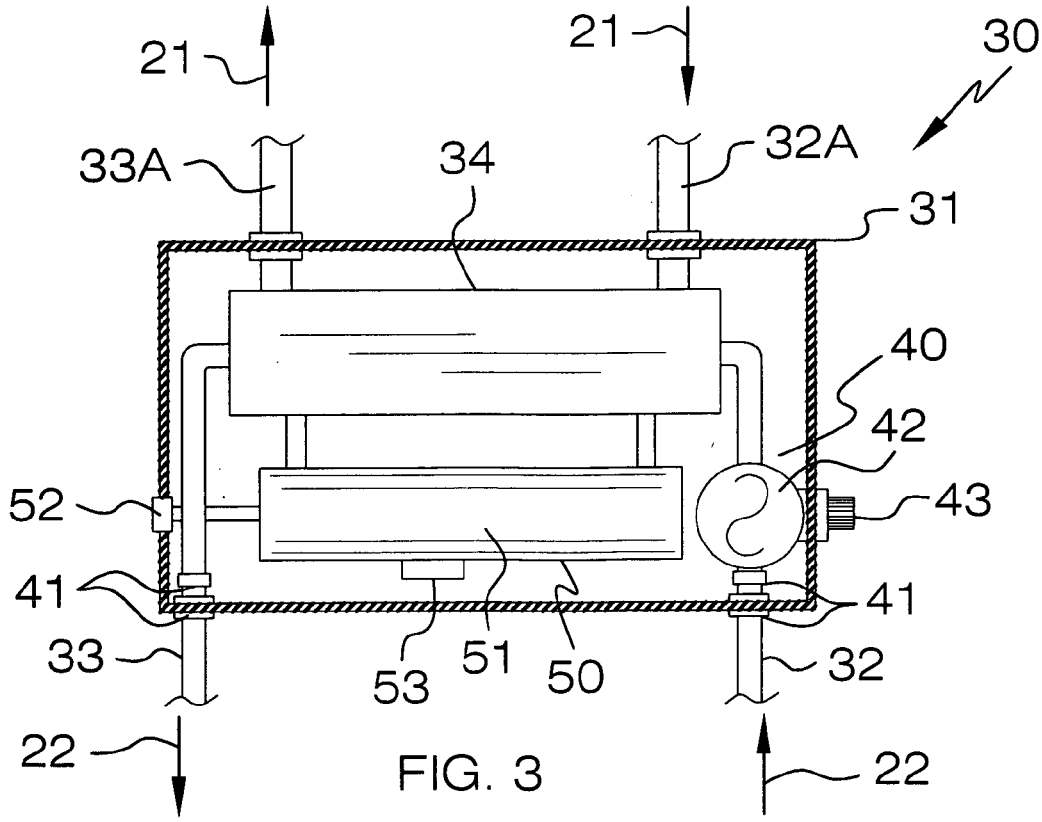
FIG. 3 is a cross section view taken along line 3—3 of the housing shown in FIG. 2 wherein the interrelationship of the major components of the heat transferring mechanism are shown, in accordance with the present invention.

Referring to FIGS. 1 through 3, a mechanism 30 is included for simultaneously transferring heat from the first coolant 21 to the second coolant 22 while advantageously and effectively maintaining the first 21 and second coolants 22 isolated during operating conditions. This is a vital feature for preventing the second coolant 22 from contaminating the first coolant 21, which can otherwise cause damage to the tractor's engine. The first coolant 21 has a first temperature entering the heat transferring mechanism 30 and further has a second temperature upon exiting the heat transferring mechanism 30. The second coolant 21 has a first temperature entering the heat transferring mechanism 30 and further has a second temperature upon exiting the heat transferring mechanism 30. The second temperature of the first coolant 21 is lower than the second temperature of the second coolant 22, which is important for allowing the first coolant to absorb heat from the tractor's engine during circulation.

Still referring to FIGS. 1 through 3, the heat transfer mechanism 30 includes a housing 31 seated to an exterior and intermediate of the tractor engine and the trailer heating system respectively. Of course, the housing 31 may be alternately located as is obvious to a person of ordinary skill in the art. A pair of inlet ports 32 are in direct fluid communication with existing coolant lines associated with the tractor engine and the trailer heating system respectively. A pair of outlet ports 33 are in direct fluid communication with selected ones of the existing coolant lines.

A water-to-water heat exchanging device 34 is seated within the housing 31 and is in direct fluid communication with the inlet 32 and outlet 33 ports, which is vital such that the first 21 and second 22 coolants fluidly pass through the heat exchanging device 34 while thermally transferring energy therein. The first temperature of the first coolant 21 is greater than the second temperature thereof. The first temperature of the second coolant 22 is less than the second temperature thereof. Thus, heat is effectively thermally transferred from the first coolant 21 to the second coolant 22 without having the coolants 21, 22 coming in direct contact.

Referring to FIGS. 3 and 4, a mechanism 40 is included for controlling an input flow rate of the second coolant 22 upstream from the heat transfer mechanism 30. Such a flow rate controlling mechanism 40 includes a plurality of solenoid valves 41 operably connected to the input 32 and output 33 ports. An electric pump 42 is operably mated to the existing coolant lines. A thermostatic rheostat 43 is directly coupled, without the use of intervening elements, to the electric pump 42. Such a thermostatic rheostat 43 is crucial for regulating a supply of power to the electric pump 42. The solenoid valves 41 are independently adaptable between open and closed positions, which are essential and advantageous for effectively allowing the second coolant 22 to freely flow through the heat exchanging device 34 when the thermostatic rheostat 43 detects that the first temperature of the second coolant 22 has dropped below a predetermined threshold temperature level.

Referring to FIGS. 2 and 3, a mechanism 50 is included for conveniently replenishing a selected quantity of the second coolant 22 as heat is transferred between the first 21 and second 22 coolants. The replenishing mechanism 50 includes a reservoir 51 seated within the housing 31 that is fluidly connected directly, without the use of intervening elements, to the heat exchanging device 34. A selected volume of the second coolant 22 is housed within the reservoir 51, which is convenient and advantageous for allowing the system 10 to operate for extended periods of time when compared to conventional cooling systems.

A gauge 52 is operably mated to the reservoir 51 and is important for conveniently and effectively displaying a level of the second coolant 22 remaining in the reservoir 51 so that a truck operator can periodically add additional second coolant 22 as need requires. Such a reservoir 51 is isolated from one inlet port 32A and one outlet port 33A associated with the first coolant 21, which is essential such that the first 21 and second 22 coolants advantageously remain isolated during heat transfer procedures. This feature effectively prevents debris in the second coolant 22 from contaminating the first coolant 21. The reservoir 51 further includes a one-way air valve 53 operably conjoined directly, without the use of intervening elements, thereto for conveniently and effectively reducing an internal air pressure of the reservoir 51 as an internal temperature of the reservoir 51 rises above a predetermined threshold level.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A system for separating coolants and reducing the likelihood of coolant contamination between tractor engines and associated trailers, said system comprising:

a control switch mounted to an internal cabin of the tractor such that a driver can manually toggle said system between operating and non-operating modes, said control switch being electrically mated to an existing power source of the tractor;

a first coolant housed within the tractor's engine;

a second coolant housed within a trailer's heating system;

means for simultaneously transferring heat from said first coolant to said second coolant while maintaining said first and second coolants isolated during operating conditions;

means for controlling an input flow rate of said second coolant upstream from said heat transfer means; and means for replenishing a selected quantity of said second coolant as heat is transferred between said first and second coolants;

wherein said first coolant has a first temperature entering said heat transferring means and further has a second temperature exiting said heat transferring means;

wherein said second coolant has a first temperature entering said heat transferring means and further has a second temperature exiting said heat transferring means.

2. The system of claim 1, wherein said heat transfer means comprises:

a housing seated exterior and intermediate of the tractor engine and the trailer heating system respectively;

a pair of inlet ports in direct fluid communication with existing coolant lines associated with the tractor engine and the trailer heating system respectively;

a pair of outlet ports in direct fluid communication with selected ones of the existing coolant lines; and a water-to-water heat exchanging device seated within said housing and being in direct fluid communication with said inlet and outlet ports such that said first and second coolants fluidly pass through said heat exchanging device while thermally transferring energy therein;

wherein said first temperature of said first coolant is greater than said second temperature of said first coolant;

wherein said first temperature of said second coolant is less than said second temperature of said second coolant.

3. The system of claim 2, wherein said replenishing means comprises:

a reservoir seated within said housing and fluidly connected directly to said heat exchanging device;

a selected volume of said second coolant being housed within said reservoir; and a gauge operably mated to said reservoir for displaying a level of said second coolant remaining in said reservoir;

wherein said reservoir is isolated from one said input port and one said output port associated with said first coolant such that said first and second coolants remain isolated during heat transfer procedures.

4. The system of claim 3, wherein said flow rate controlling means comprises:

a plurality of solenoid valves operably connected to said input and output ports;

an electric pump operably mated to said existing coolant lines;

a thermostatic rheostat directly coupled to said electric pump, said thermostatic rheostat regulating a supply of power to said electric pump;

wherein said solenoid valves are independently adaptable between open and closed positions for allowing said second coolant to freely flow through said heat exchanging device when said thermostatic rheostat detects that said first temperature of said second coolant has dropped below a predetermined threshold temperature level.

5. The system of claim 3, wherein said reservoir further comprises:

a one-way air valve operably conjoined directly thereto for reducing an internal air pressure of said reservoir as an internal temperature of said reservoir rises above a predetermined threshold level.

6. A system for separating coolants and reducing the likelihood of coolant contamination between tractor engines and associated trailers, said system comprising:

a control switch mounted to an internal cabin of the tractor such that a driver can manually toggle said system between operating and non-operating modes, said control switch being electrically mated to an existing power source of the tractor;

a first coolant housed within the tractor's engine;

a second coolant housed within a trailer's heating system;

wherein said first and second coolants have unique boiling and freezing temperatures respectively;

means for simultaneously transferring heat from said first coolant to said second coolant while maintaining said first and second coolants isolated during operating conditions;

means for controlling an input flow rate of said second coolant upstream from said heat transfer means; and means for replenishing a selected quantity of said second coolant as heat is transferred between said first and second coolants;

wherein said first coolant has a first temperature entering said heat transferring means and further has a second temperature exiting said heat transferring means;

wherein said second coolant has a first temperature entering said heat transferring means and further has a second temperature exiting said heat transferring means.

7. The system of claim 6, wherein said heat transfer means comprises:

a housing seated exterior and intermediate of the tractor engine and the trailer heating system respectively;

a pair of inlet ports in direct fluid communication with existing coolant lines associated with the tractor engine and the trailer heating system respectively;

a pair of outlet ports in direct fluid communication with selected ones of the existing coolant lines; and a water-to-water heat exchanging device seated within said housing and being in direct fluid communication with said inlet and outlet ports such that said first and second coolants fluidly pass through said heat exchanging device while thermally transferring energy therein;

wherein said first temperature of said first coolant is greater than said second temperature of said first coolant;

wherein said first temperature of said second coolant is less than said second temperature of said second coolant.

8. The system of claim 7, wherein said replenishing means comprises:

a reservoir seated within said housing and fluidly connected directly to said heat exchanging device;

a selected volume of said second coolant being housed within said reservoir; and a gauge operably mated to said reservoir for displaying a level of said second coolant remaining in said reservoir;

wherein said reservoir is isolated from one said input port and one said output port associated with said first coolant such that said first and second coolants remain isolated during heat transfer procedures.

9. The system of claim 8, wherein said flow rate controlling means comprises:

a plurality of solenoid valves operably connected to said input and output ports;

an electric pump operably mated to said existing coolant lines;

a thermostatic rheostat directly coupled to said electric pump, said thermostatic rheostat regulating a supply of power to said electric pump;

wherein said solenoid valves are independently adaptable between open and closed positions for allowing said second coolant to freely flow through said heat exchanging device when said thermostatic rheostat detects that said first temperature of said second coolant has dropped below a predetermined threshold temperature level.

10. The system of claim 8, wherein said reservoir further comprises:

a one-way air valve operably conjoined directly thereto for reducing an internal air pressure of said reservoir as an internal temperature of said reservoir rises above a predetermined threshold level.

11. A system for separating coolants and reducing the likelihood of coolant contamination between tractor engines and associated trailers, said system comprising:

a control switch mounted to an internal cabin of the tractor such that a driver can manually toggle said system between operating and non-operating modes, said control switch being electrically mated to an existing power source of the tractor;

a first coolant housed within the tractor's engine;

a second coolant housed within a trailer's heating system;

wherein said first and second coolants have unique boiling and freezing temperatures respectively;

means for simultaneously transferring heat from said first coolant to said second coolant while maintaining said first and second coolants isolated during operating conditions;

means for controlling an input flow rate of said second coolant upstream from said heat transfer means; and means for replenishing a selected quantity of said second coolant as heat is transferred between said first and second coolants;

wherein said first coolant has a first temperature entering said heat transferring means and further has a second temperature exiting said heat transferring means;

wherein said second coolant has a first temperature entering said heat transferring means and further has a second temperature exiting said heat transferring means;

wherein said second temperature of said first coolant is lower than said second temperature of said second coolant.

12. The system of claim 11, wherein said heat transfer means comprises:

a housing seated exterior and intermediate of the tractor engine and the trailer heating system respectively;

a pair of inlet ports in direct fluid communication with existing coolant lines associated with the tractor engine and the trailer heating system respectively;

a pair of outlet ports in direct fluid communication with selected ones of the existing coolant lines; and a water-to-water heat exchanging device seated within said housing and being in direct fluid communication with said inlet and outlet ports such that said first and second coolants fluidly pass through said heat exchanging device while thermally transferring energy therein;

wherein said first temperature of said first coolant is greater than said second temperature of said first coolant;

wherein said first temperature of said second coolant is less than said second temperature of said second coolant.

13. The system of claim 12, wherein said replenishing means comprises:

a reservoir seated within said housing and fluidly connected directly to said heat exchanging device;

a selected volume of said second coolant being housed within said reservoir; and a gauge operably mated to said reservoir for displaying a level of said second coolant remaining in said reservoir;

wherein said reservoir is isolated from one said input port and one said output port associated with said first coolant such that said first and second coolants remain isolated during heat transfer procedures.

14. The system of claim 13, wherein said flow rate controlling means comprises:

a plurality of solenoid valves operably connected to said input and output ports;

an electric pump operably mated to said existing coolant lines;

a thermostatic rheostat directly coupled to said electric pump, said thermostatic rheostat regulating a supply of power to said electric pump;

wherein said solenoid valves are independently adaptable between open and closed positions for allowing said second coolant to freely flow through said heat exchanging device when said thermostatic rheostat detects that said first temperature of said second coolant has dropped below a predetermined threshold temperature level.

15. The system of claim 13, wherein said reservoir further comprises:

a one-way air valve operably conjoined directly thereto for reducing an internal air pressure of said reservoir as an internal temperature of said reservoir rises above a predetermined threshold level.

* * * * *